US005531435A

United States Patent [19]

Momose

[11] Patent Number: 5,531,435

[45] Date of Patent: Jul. 2, 1996

[54] PAPER-FEED CONTROL APPARATUS FOR PRINTER

[75] Inventor: Hiroaki Momose, Suwa, Japan

[73] Assignee: Seiko Epson Corporation, Tokyo-to, Japan

[21] Appl. No.: 500,313

[22] Filed: Jul. 6, 1995

Related U.S. Application Data

[63] Continuation of Ser. No. 185,715, Jan. 24, 1994, abandoned.

[30] Foreign Application Priority Data

Feb. 1, 1993 [JP] Japan ..... 5-014565

[51] Int. Cl.[6] ..... B65H 7/02

[52] U.S. Cl. ..... 271/258.03; 271/114

[58] Field of Search ..... 271/10.01, 16, 271/10.03, 10.05, 10.09, 10.10, 10.11, 110, 258.01, 258.02, 258.03, 258.04, 265.04, 266

[56] References Cited

U.S. PATENT DOCUMENTS

| | | | |
|---|---|---|---|
| 4,110,032 | 8/1978 | Hubbard et al. | 271/258 X |
| 4,444,385 | 4/1984 | Berry | 271/114 X |
| 4,482,143 | 11/1984 | Della Torre | 271/258 X |
| 5,056,771 | 10/1991 | Beck et al. | 271/114 |

FOREIGN PATENT DOCUMENTS

| | | |
|---|---|---|
| 0279530 | 8/1988 | European Pat. Off. . |
| 59-187880 | 10/1984 | Japan . |
| 01110174 | 4/1989 | Japan . |
| 01168468 | 7/1989 | Japan . |

OTHER PUBLICATIONS

Patent Abstracts of Japan, vol. 13, No. 327 (M–854) Jul. 24, 1989.

Patent Abstracts of Japan, vol. 13, No. 441 (M876) Oct. 4, 1989.

Patent Abstracts of Japan, vol. 9, No. 51 (M361) Mar. 6, 1985.

*Primary Examiner*—William E. Terrell
*Assistant Examiner*—Tamara Kelly
*Attorney, Agent, or Firm*—Ladas & Parry

[57] ABSTRACT

The present invention relates to a paper-feed control apparatus for a printer that reduces the frequency of paper-feed failures by automatically performing a clearing operation if a malfunction should occur in the supply of paper. Paper stacked in a paper tray 1 is separated one sheet at a time by separator tabs 5, and then is sent in a conveyor direction by the rotation of a feed roller 3. If the paper should jam partway during this separation and conveyor process, a paper-feed motor that drives the feed roller 3 is driven intermittently. This intermittent operation produces a large paper conveyor force from repeated generation of a large frictional force between the roller and the paper, and thus the frequency of paper-feed failures is reduced.

4 Claims, 5 Drawing Sheets

PAPER-FEED CONTROL APPARATUS FOR PRINTER

This is a continuation of application(s) Ser. No. 08/185,715 filed Jan. 24, 1994 which has been abandoned.

FIELD OF THE INVENTION

The present invention relates to a paper-feed control apparatus that controls the supply of paper to a printer and, in particular, to an apparatus designed to solve the problem of paper jamming.

PRIOR ART

In general, a printer holds a stack of many sheets of paper in a paper tray mounted on the main printer unit. The paper stacked in this manner is drawn a sheet at a time into the printer by rollers, and is printed thereby. During this time, the configuration is such that a group of two or more sheets of paper is prevented from being drawn in. However, slippage can occur between the rollers and the paper and the paper can become jammed partway along its conveyor path, so that even though a single sheet of paper is drawn in at a time, malfunctions can occur. To detect such a malfunction, a paper sensor is provided partway along the paper conveyor path. In addition, if this paper sensor does not detect the paper even after the expiry of a predetermined time that the paper should take from the start of the paper feed by the rollers until the paper reaches the position of the paper sensor, the paper feed is deemed to have failed and an error display is posted. This can inform the user that the paper feed was not performed correctly, and recovery processing is required.

PROBLEM TO BE SOLVED BY THE PRESET INVENTION

The printer of the above configuration has the irritating problem that the user has to perform recovery processing every time the paper feed malfunctions.

SUMMARY OF THE INVENTION

The present invention has been designed to solve the above problem and has as its objective the provision of a paper-feed control apparatus that automatically copes with any malfunction in the paper feed that may occur, and reduce the frequency of paper-feed failures to as few as possible.

MEANS OF SOLVING THE PROBLEM

To achieve the above described objective, the present invention provides a paper-feed control apparatus for a printer that controls the transfer of sheets of paper, one sheet at a time, along a paper conveyor path by the operation of a paper-feed motor in response to a paper-feed command, to ensure that paper stacked in a paper tray is sequentially printed upon by a print mechanism. This paper-feed control apparatus for a printer is characterized in comprising a paper sensor which is provided at a predetermined position in the paper conveyor path and which detects the arrival of paper sent from the paper tray by the operation of the paper-feed motor; a timer means which generates an output when a predetermined time has elapsed after the paper-feed command is issued; a paper-feed halt means which issues a paper-feed halt signal if a paper detection signal is not received from the paper sensor even after the output has been generated by the timer means; and a paper-feed motor control means which produces a short-time intermittent operation of the paper-feed motor in response to the paper-feed halt signal.

The present invention provides that, if the paper-feed halt signal has been received, the paper-feed motor control means operates the paper-feed motor by an amount that is sufficient to allow the paper to reach the position of the paper sensor, after effecting the short-time intermittent operation a number of times.

The preset invention further provides the paper-feed motor control means with a counter means that counts the number of times the paper-feed motor is intermittently operated; and the paper-feed motor control means determines that a paper-feed failure has occurred if paper is not detected by the paper sensor even after the value counted by the counter means has reached a predetermined value.

In the apparatus in further accordance with the present invention, the paper tray is provided with a pair of separator tabs which are positioned at leading corner portions of the paper stacked in the paper tray, the two sides of the leading edge of the paper being guided thereby and the leading edge of the paper engaging therewith, and this engagement is released by pressing on the paper and flexing the corner portions thereof.

ACTION OF THE PRESENT INVENTION

The apparatus in accordance with the present invention generates a paper-feed halt signal if the paper sensor does not detect the paper when a predetermined period of time has elapsed after the paper feed has started. On reception of the paper-feed halt signal, the paper-feed motor control means performs intermittent operation of the paper-feed motor. In other words, the paper-feed motor is stopped and started repeatedly at small intervals of time. This causes a frictional force to be intermittently generated between the paper and the roller, which released the paper-feed malfunction status and is highly likely to return the printer to its normal paper-feed status, so that ultimately the frequency of paper-feed failures is reduced.

The apparatus in accordance with the present invention also causes the paper-feed motor to operate for a relatively large amount before the paper-feed motor is operated intermittently at small intervals of time.

The apparatus in accordance with the present invention further determines that a paper-feed failure has occurred if the paper jam is not cleared after a predetermined number of repeats of the intermittent operation, without repeating the intermittent operation wastefully.

In the apparatus in further accordance with the present invention, the paper in the paper tray engages with the separator tabs and is flexed therby, so that a one sheet of paper at time is separated from the separator tabs, and thus paper can be fed reliably one sheet at a time.

EFFECTS OF THE PRESENT INVENTION

As described above, since the apparatus in accordance with the present invention operates the paper-feed motor intermittently to repeatedly generate a large frictional force between the feed roller and the paper if a paper-feed malfunction should occur, it is highly likely that the paper-feed malfunction status will be released, and thus the frequency of paper-feed failures will ultimately be reduced.

The apparatus causes the paper-feed motor to operate by an amount that is sufficient to allow the paper to reach the position of the paper sensor, then effects the short-time intermittent operation, so that it is considered capable of releasing in a short period of time minor paper jams that are expected to occur in normal operation. By determining that a paper-feed failure has occurred if the paper jam is not released after a predetermined number of repeats of the intermittent operation, the apparatus can respond rapidly to serious paper jams.

Since the apparatus is provided with a pair of separator tabs at the corner portions at the leading edge of the paper tray, the paper in the paper tray engages with the separator tabs and is flexed thereby, so that a one sheet of paper at a time is separated from the separator tabs, and thus paper can be fed reliably one sheet at a time and paper jamming is not likely to occur.

DETAILED DESCRIPTION OF THE PREFERRED EMBODIMENT

Figure 1:
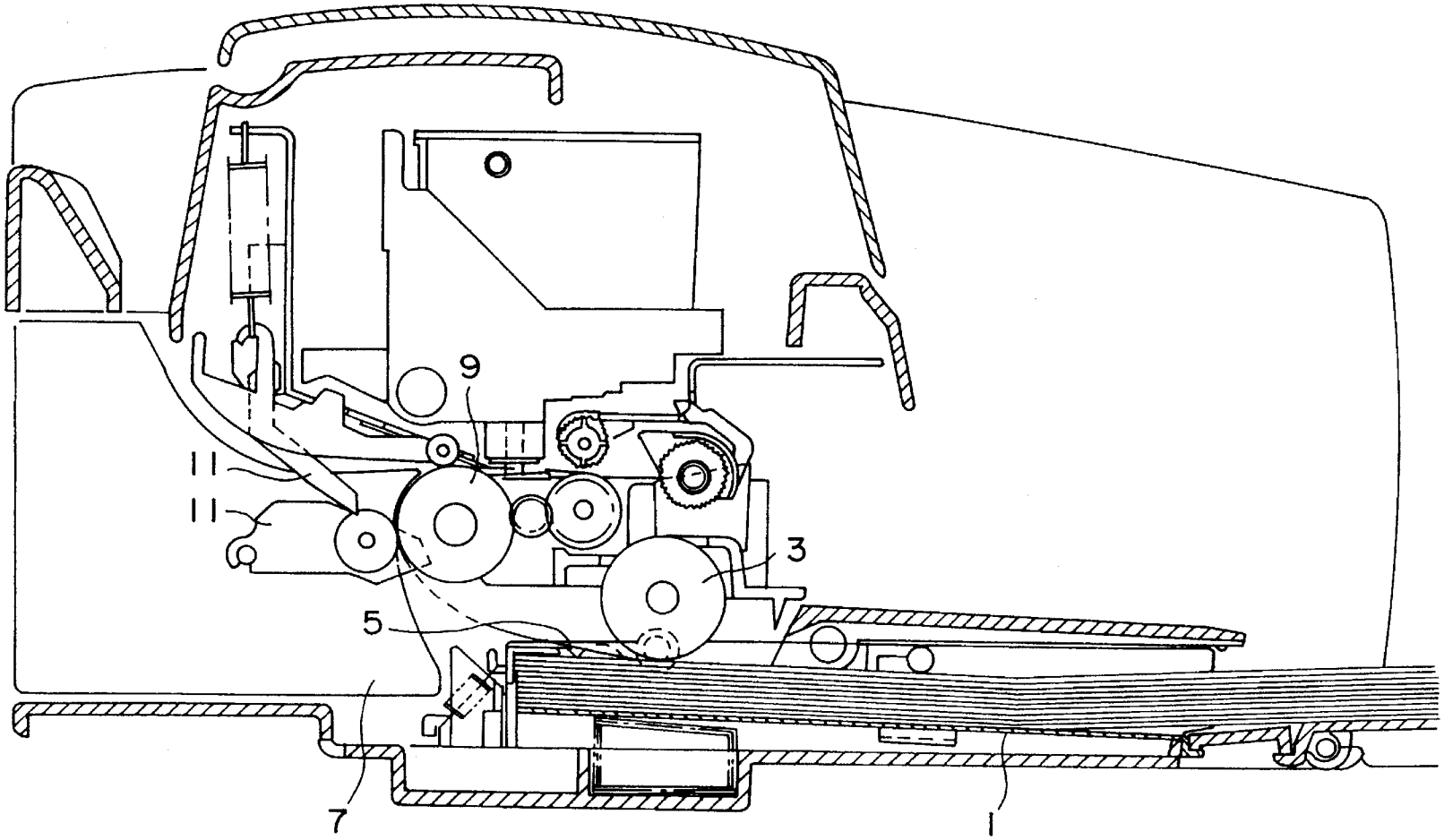
FIG. 1 is a cross-sectional view of one example of the paper-feed mechanism that is the main component of a printer to which the present invention is applied.

A cross-sectional view of one example of the paper-feed mechanism that is the main component of a printer to which the present invention is applied is shown in FIG. 1. First, a stack of a large number of sheets of paper is piled in a paper tray 1. A feed roller 3 that provides the paper feed is in contact with the top of this stack of paper. This feed roller 3 is designed to be driven by a paper-feed motor that is not shown in the figure. In this case, a stepping motor that goes through 360 steps in one rotation is used as the paper-feed motor. Separator tabs 5 are provided in the vicinity of a leading-edge portion of the paper tray 1, in the paper-feed direction. These separator tabs 5 operate to separate the uppermost sheet of paper of the stack from the second and lower sheets in the stack, every time the paper feed is activated by the feed roller 3. In other words, the leading edge in the paper-feed direction of the uppermost sheet of paper is flexed thereby so that it is separated from the second and subsequent sheets of paper. This flexing of the uppermost sheet of paper is subsequently removed by the paper feed initiated by the feed roller 3, and the uppermost sheet alone is fed out over the separator tabs 5. This uppermost sheet of paper is then sent along a conveyor path by the feed roller 3. During this time, a paper-transfer guide 7 on the conveyor path ensures that the paper is sent correctly by a paper-transfer roller 9 while it is in contact with the paper-transfer guide 7. The paper is then conveyed further onward by the paper-transfer roller 9. A paper-detection lever 11 is attached by a spring in the vicinity of the paper-transfer guide 7, in order to detect that the paper has been conveyed as far as the paper-transfer roller 9. If the paper has been transferred as far as the paper-detection lever 11, the paper-detection lever 11 is pushed upwards by the paper and an electrical switch that is not shown in the figure is turned on thereby. This turning on of the switch detects that the paper has been transferred correctly, or rather, that the paper feed has been successful. However, if the paper has not arrived at the paper-detection lever 11 even after a predetermined time has elapsed after the paper feed started, it is determined that a malfunction has occurred in the paper feed and a paper-feed halt signal is generated.

Causes of malfunctions in the paper feed will now be described with reference to FIG. 1. The paper-feed can malfunction if the load applied to the paper in the opposite direction to the conveyor direction when the paper is conveyed is greater than the force with which the feed roller 3 conveys the paper, in other words, than the frictional force between the roller and the paper. There are two main causes for this phenomenon. One occurs when the uppermost sheet of paper comes into contact with the separator tabs 5 and is flexed thereby. At this point, the paper could be returned by the flexure force, back in the direction opposite to the conveyor direction. Another occurs when the sheet of paper separated by the separator tabs 5 hits the paper-transfer guide 7 and is curved into the conveyor direction. In this case, a force that is greater than the force applied to the paper by the feed roller 3 is applied to the paper in the direction opposite to the conveyor direction.

Once slippage has occurred between the paper and the feed roller because of one of the above causes, the frictional force generated between the feed roller 3 and the paper is less than the frictional force generated when the paper is conveyed normally, so this frictional force is exceeded by the load operating to convey the paper in the direction opposite to the conveyor direction, and thus it is difficult to return to the normal paper-feed status. The present invention is designed to operate the feed roller 3 intermittently once a paper-feed malfunction has been detected, in order to repeatedly generate a frictional force and thus ensure a high conveyor force. In this manner, the present invention is characterized in that it can overcome the load generated when the paper is conveyed, and thus ensure that the paper feed proceeds normally.

Figure 2:
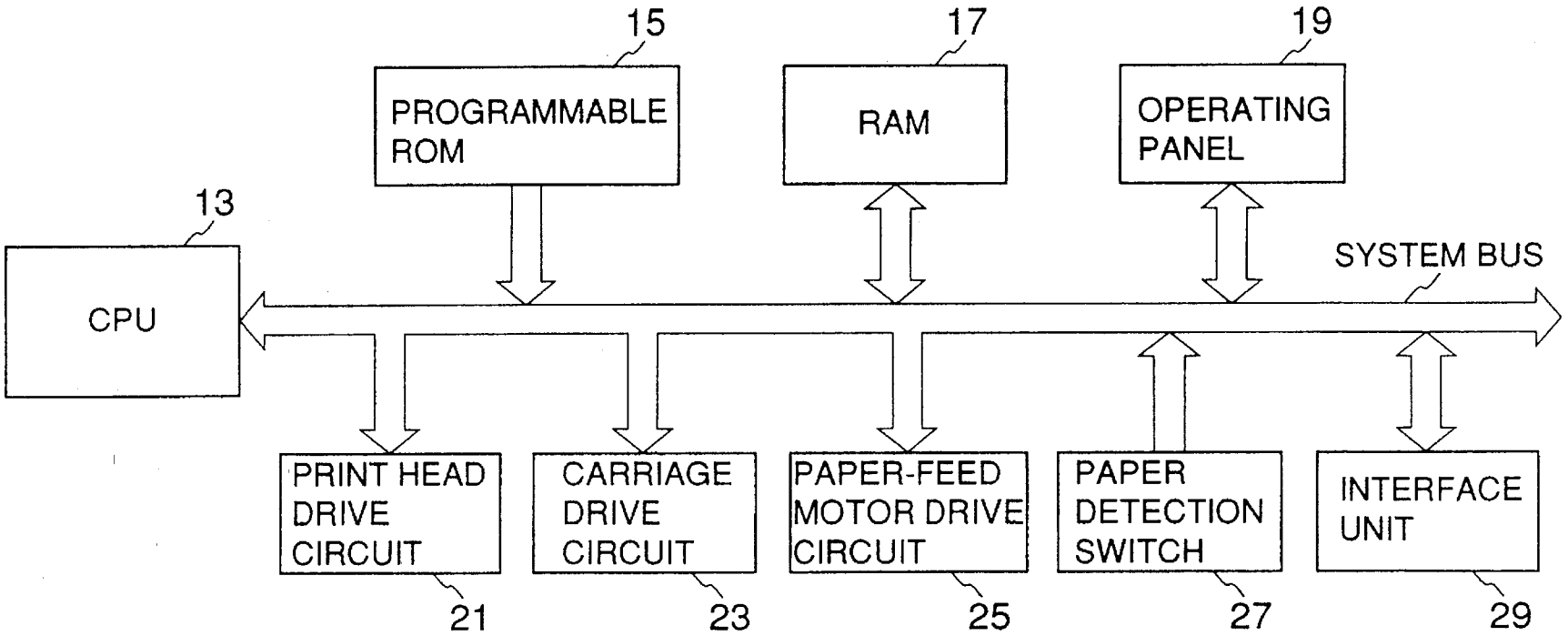
FIG. 2 is a diagram of the system configuration of one embodiment of the paper-feed control apparatus in accordance with the present invention.

The system configuration of the controller that controls the paper feed is shown in FIG. 2. This system is provided with a CPU 13 for controlling the entire printer, including the control of the paper-feed operation. The CPU 13 is connected via a system bus to a programmable ROM 15 that contains programs for running the CPU 13, a RAM 17 used by the CPU 13 for various types of processing, and an operating panel 19 which has buttons for operations such as starting and stopping the printer, or a display for showing various messages including error messages. The CPU 13 is also connected via the system bus to a drive circuit 25 of a paper-feed motor that drives the feed roller, and a paper detection switch 27 that is operated by the paper-detection lever 11. In addition to paper-feed control, the CPU 13 also controls the processing of print data sent from a host computer, which is not shown in the figure, and the driving of the print head that prints the data and the carriage that moves the print head. For these purposes, this system bus is also connected to an interface unit 29 for communicating with the host computer, a drive circuit 23 for driving the carriage, and a drive circuit 21 for driving the print head.

The operation of the above components that are affected by the present invention will now be described briefly. If it is determined that the paper has not reached the position of the paper detection switch 27 which acts as a paper sensor, when the predetermined time after paper-feed start has elapsed, a signal indicating that fact is sent to the CPU 13 via the system bus. The CPU 13 then controls the paper-feed motor drive circuit 25 via the system bus to operate the paper-feed motor intermittently. Paper-feed failure is determined and an error message is displayed only if the paper is not detected by the paper sensor even after this intermittent operation.

Figure 3:
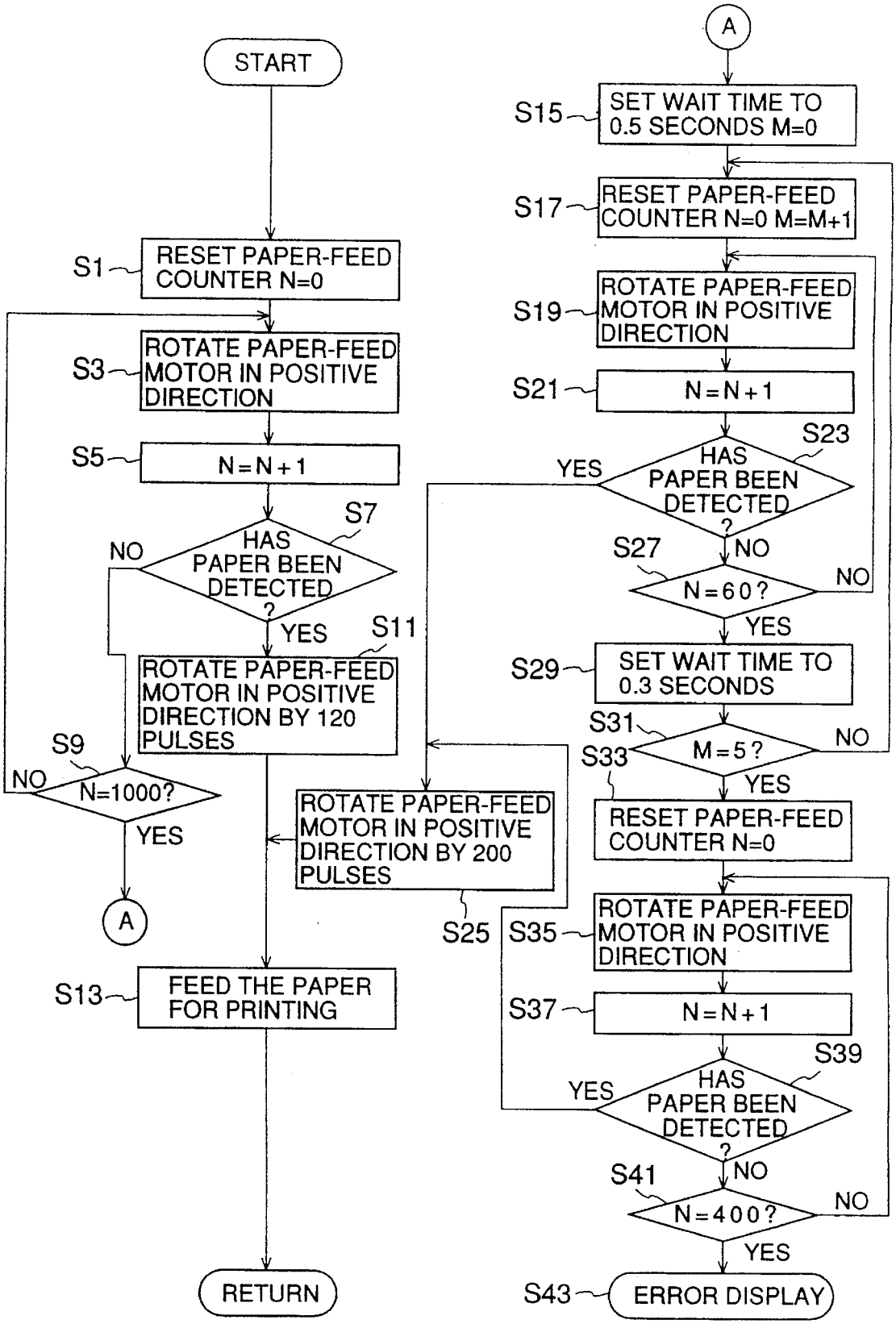
FIG. 3 is a flow chart of the processing of paper-feed control in the embodiment shown in FIG. 2.

A detailed flow of processing during the paper-feed performed by the controller shown in FIG. 2 is shown in FIG. 3. In this flowchart, rotation of the paper-feed motor in the direction in which paper is conveyed is called the positive direction, and rotation in the direction opposite to that in which paper is conveyed is called the negative direction. Note that this embodiment of the present invention uses a pulse motor as the paper-feed motor.

First, when the paper feed starts, the value in a paper-feed counter that indicates the rotational distance of the paper-feed motor, or rather, the number of sheets of paper N that the motor has sent, is reset to zero (step S1). Next, the paper-feed motor is rotated by one pulse in the positive direction (step S3). The value N in the paper-feed counter is then incremented by 1 (step S5). Next, the system determines whether or not the paper has been detected by the paper sensor (step S7). If the paper has not yet been detected, the system determines whether or not the value N in the paper-feed counter has reached 1000 (step S9). In this case, a value of 1000 expresses a distance-that is thought to be sufficient for the paper to reach the paper sensor after the start of the paper feed. In other words, if the paper-feed motor is given 1000 pulses when paper feed is proceeding normally, the paper has plenty of time to reach the position of the paper sensor. At this point, if the value N in the paper-feed counter has not reached 1000, the flow returns to the above described step S3 and once again the motor is operated in the positive direction by one pulse and the value N is incremented by one. This is repeated until the paper is detected by the paper sensor. In this manner, the paper-feed motor is rotated in the positive direction until the value N reaches its maximum value of 1000.

If the paper is detected by the paper sensor before the value N reaches 1000, the paper-feed motor is rotated in the positive direction by 120 pulses (step S11) to convey the paper. This value of 120 pulses is equivalent to the distance necessary for the paper to be sent as far as the printing portion that is not shown in the figures. Once the paper has been sent in this manner to the portion of the printer that performs the printing, paper-feed processing by a method that is known in the art starts for the printing (step S13).

If step S9 determines that the value N has reached 1000 before the paper is detected by the paper sensor, the flow proceeds to a step S15. First, the paper-feed is halted for a predetermined short time, such as 0.5 seconds, and a value M that expresses the number of times the paper-feed is subjected to intermittent operation is reset to zero (step S15). This value of 0.5 seconds is the approximate time required for the position of the paper that has been flexed by the separator tabs to fall. After a wait of 0.5 seconds, the value N of the paper-feed counter is reset to zero and the number of intermittent operations M of the paper-feed motor is incremented by one (step. S17). Next, the paper-feed motor is rotated in the positive direction by one pulse (step S19) and the value N of the paper-feed counter is incremented by 1 (step S21). At this point, the system determines whether or not the paper has been detected (step S23). If the paper has been detected, the paper-feed motor is rotated in the positive direction by 200 pulses (step S25). This value of 200 pulses is equivalent to the distance necessary for the paper to be sent as far as the printing portion that is not shown in the figures.

If the paper is not detected in step S23, the system determines whether or not the value N has reached 60 (step S27). This value of 60 pulses is equivalent to the distance fed by one intermittent operation of the paper-feed motor. Once the paper has been fed by 60 pulses, a 0.3-second wait time starts (step S29). This value of 0.3 seconds is the time required for the flexing in the angle of the paper away from the separator tabs to come off and return to its original orientation. The number of 60 pulses means that the number of paper-feed steps of the printer is 60. Thus, the intermittent operation consists of a feed of 60 pulses and a 0.3-second rest. Subsequently, the system checks whether the number of intermittent operations has reached a certain value, such as five (step S31). If the number has not yet reached five, the flow returns to step S17, the value in the paper-feed counter is reset to zero, and the number of intermittent operations M is incremented by one. This loop repeats until the number of intermittent operations M reaches the maximum value of five.

If the paper is detected by the paper sensor in step S23 partway through this intermittent operation repetition loop, the paper-feed motor is rotated by 200 pulses (step S25) and paper-feed processing by a method that is known in the art then starts for the printing (step S13), in the same manner as described above.

This solving of the problem of paper-jamming within the intermittent operation repetition loop leaves the problem that the paper could hit the paper-feed guide and jam, in other words, the paper could jam close to the paper sensor. Similarly, if the paper should jam at the position of the separator tab, etc., the paper will be released by the intermittent operation, but the distance obtained by the repeating of the 60-pulse drive five times will not be sufficient to allow the paper to reach the paper sensor. In such a case, the processing described below is provided immediately afterwards if the paper has not been detected even after five repetitions of the intermittent operation.

First, the value N in the paper-feed counter is reset to zero (step S33) and the paper-feed motor is rotated by one pulse in the positive direction (step S35). The value N is then incremented by one (step S37) and the system determines whether or not the paper has been detected (step S39). If the paper has been detected, the paper-feed motor is rotated in the positive direction by 200 pulses, in the same manner as in step S25. If the paper has not been detected, the system determines whether or not the value N has reached 400 (step S41) and repeats the processing until N reaches 400. However, if paper is detected by the paper sensor at step S39 partway through this loop, the flow branches to step S25 and the paper-feed processing for printing is performed, in the same manner as described above.

Note that if the paper-feed force is adjusted by varying the speed at which the paper is conveyed for each operation during the intermittent operation, the reliability of paper feed can be increased, without being affected by differences in paper quality, such as thickness.

If the value N reaches 400 but the paper is still not detected even after the above steps are performed, the system finally determines that a paper-feed failure has occurred, and displays an appropriate error message to prompt the user to perform recovery processing.

Figure 4:
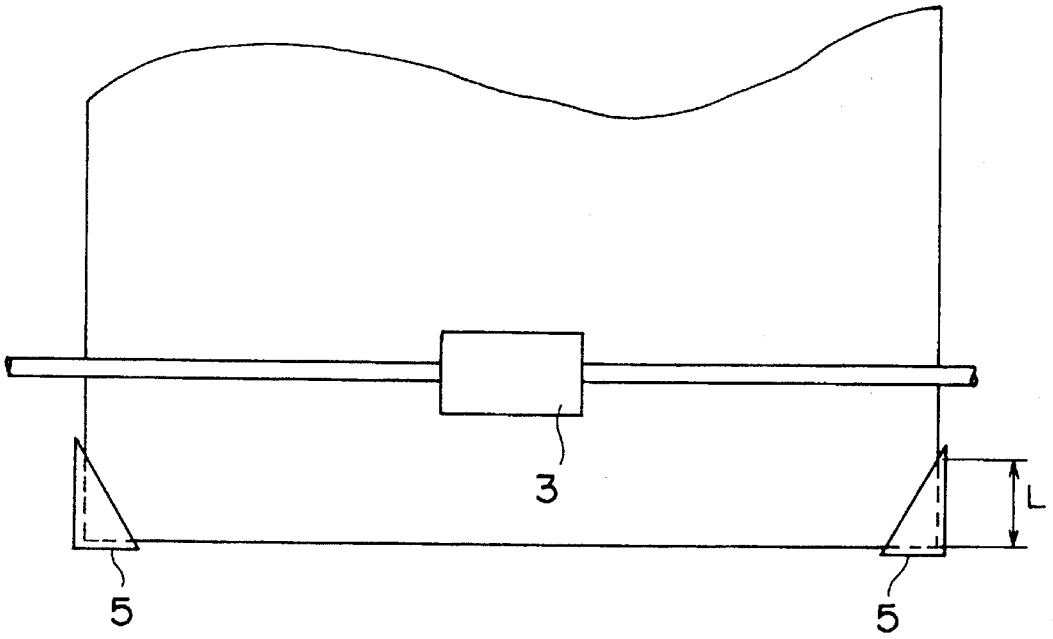
FIG. 4 is a diagram illustrative of separator tabs in the paper tray of the paper-feed mechanism shown in FIG. 1.

The separator tabs 5 provided at the leading edge of the paper tray in this embodiment of the present invention are shown in FIG. 4. These separator tabs 5 are configured of a form that surrounds the corner portions of the paper and are provided at both sides of the leading edge in the conveyor direction of the paper tray 1, in such a manner as to guide the sides at the leading edge of the paper and also engage with the leading edge of the paper. As shown in the figure, the shape is such that the corner portions of the box are cut away into triangles, and the corners of the paper are enclosed therein. The length L of the separator tabs 5 in the direction along the sides of the paper is a length equivalent to approximately 60 steps of the stepping motor, which is the number of feed steps of the printer. Incidentally, one step is 1/360", which is approximately 0.07 mm.

Figure 5:
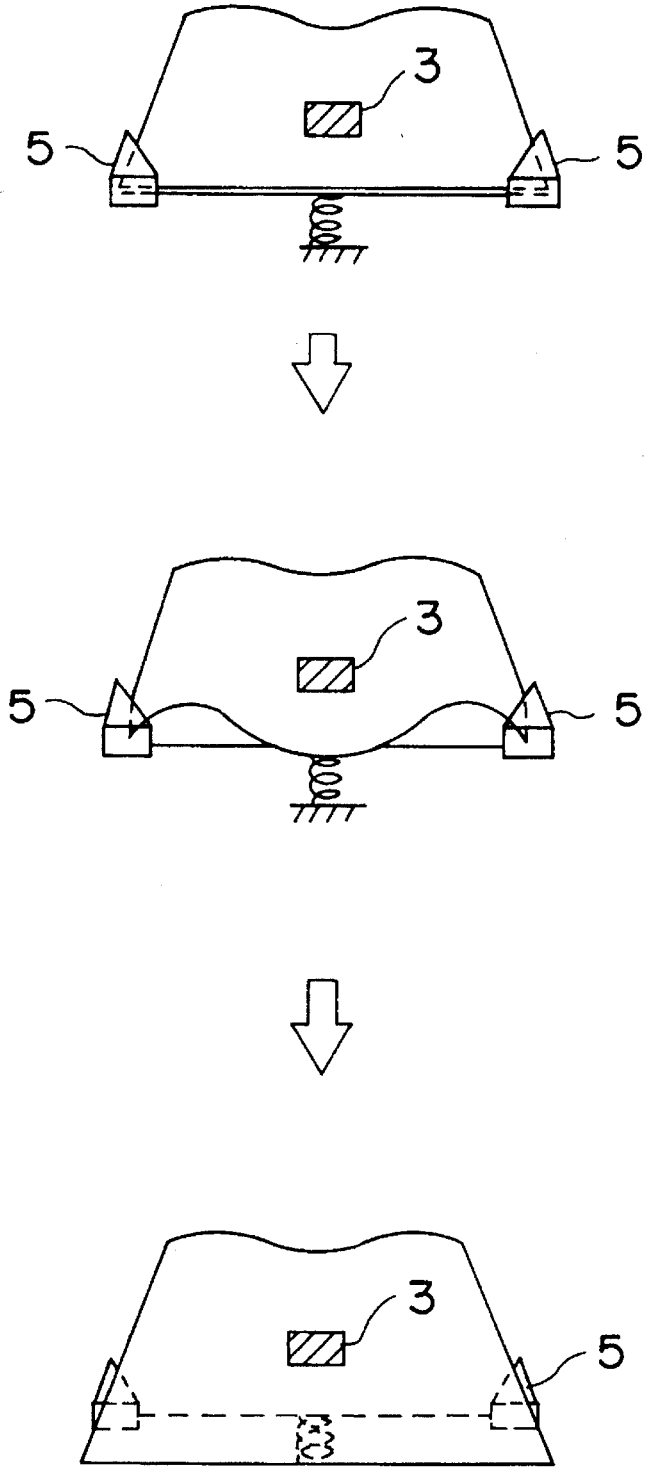
FIG. 5 illustrates the operation of the separator tabs of FIG. 4.

The action of the paper with respect to the separator tabs 5 is illustrated in FIG. 5. The uppermost portion of FIG. 5 shows the paper engaged within the separator tabs 5 of the paper tray 1 and pushed up lightly by the elastic force of a spring. With the paper in this state, if the paper is pushed forward enough from the trailing edge thereof that it flexes, as shown in the middle portion of FIG. 5, the paper flicks out from under the separator tabs 5 and lies on top of them, as shown in the lowermost portion of FIG. 5. This action of the paper from the flexing until it lies on top of the separator tabs 5 separates a single sheet of paper from the stack, without causing several sheets to be fed out. As a result, paper jamming is not likely to occur.

What is claimed is:

1. A paper-feed control apparatus for a printer that controls transfer of sheets of paper from a paper tray, one sheet at a time, along a paper conveyor path to a printer by operation of a paper-feed motor in response to a paper-feed control command, said paper-feed control apparatus comprising:

a paper sensor which is provided at a predetermined position in said paper conveyor path and which detects arrival of a paper sheet sent from said paper tray by the operation of said paper-feed motor;

a timer means which generates an output when a predetermined time has elapsed after said paper-feed command is issued;

a paper-feed halt means which issues a paper-feed halt signal if a paper detection signal is not received from said paper sensor after said output has been generated by said timer means; and a paper feed-motor control means which produces a plurality of short-time intermittent operations of said paper-feed motor in response to said paper-feed halt signal and wherein if said paper-feed halt signal has been received, said paper-feed motor control means operates said paper-feed motor by an amount that is sufficient to allow the paper sheet to reach the position of said paper sensor after said short-time intermittent operations, said paper-feed motor comprising a step motor, said paper-feed motor control means operating said step motor intermittently in step by step operation for incrementally advancing said paper sheet after receipt of said paper-feed halt signal, said paper-feed motor being operated over a relatively large number of steps to transport the paper sheet from said tray to said paper sensor, said step motor being advanced step-by-step during each said short-time intermittent operation, with alternating advancing and halting, over a number of steps substantially less than the number necessary to transport the sheet from the tray to the paper sensor.

2. A paper-feed control apparatus for a printer in accordance with claim 1, wherein:

said paper-feed motor control means is provided with a counter means that counts a number of times said paper-feed motor is intermittently operated; and said paper-feed motor control means determines that a paper-feed failure has occurred if paper is not detected by said paper sensor after said counter means has counted to a predetermined value.

3. A paper-feed control apparatus for a printer in accordance with claim 1, wherein:

said paper tray is provided with a pair of separator tabs which are positioned at leading corner portions of said paper stacked in said paper tray, two sides of a leading edge of said paper being guided thereby and the leading edge of said paper engaging therewith, and said engaging is released by a pressing means acting on said paper and flexing said corner portions.

4. A paper-feed control apparatus for a printer in accordance with claim 1, wherein said timer means comprises a counter means which establishes paper-feed by said motor of an amount, in said predetermined time, to reach said position of said paper sensor.

* * * * *